US005422710A

United States Patent [19]

Shirasaka et al.

[11] Patent Number: 5,422,710

[45] Date of Patent: Jun. 6, 1995

[54] SHEET DISCHARGING DEVICE FOR USE IN AN IMAGE FORMING APPARATUS

[75] Inventors: Kazumi Shirasaka; Akinobu Nakahata; Masahiro Shinohara; Kenji Oda, all of Osaka; Kouji Migita, Fukuoka, all of Japan

[73] Assignee: Mita Industrial Co., Ltd., Osaka, Japan

[21] Appl. No.: 14,434

[22] Filed: Feb. 5, 1993

[30] Foreign Application Priority Data

Feb. 14, 1992 [JP] Japan ..... 4-028379

[51] Int. Cl.[6] ..... G03G 15/00

[52] U.S. Cl. ..... 355/282; 219/216; 355/295

[58] Field of Search ..... 355/295, 285, 289, 290, 355/309, 308; 219/216

[56] References Cited

U.S. PATENT DOCUMENTS

| | | | |
|---|---|---|---|
| 3,937,637 | 2/1976 | Moser et al. . | |
| 4,541,707 | 9/1985 | Yoshinaga | 219/216 X |
| 4,933,726 | 6/1990 | Moriyama | 355/309 |
| 5,103,267 | 4/1992 | Wada et al. | 355/321 |

FOREIGN PATENT DOCUMENTS

| | | | |
|---|---|---|---|
| 2436218 | 7/1974 | Germany . | |
| 0191176 | 8/1988 | Japan | 355/289 |
| 0192068 | 8/1988 | Japan | 355/289 |
| 0249871 | 10/1988 | Japan | 355/289 |
| 0166078 | 6/1989 | Japan | 355/289 |
| 372389 | 3/1991 | Japan . | |
| 2105861 | 8/1982 | United Kingdom . | |

*Primary Examiner*—A. T. Grimley
*Assistant Examiner*—Thu A. Dang
*Attorney, Agent, or Firm*—Jordan and Hamburg

[57] ABSTRACT

A sheet discharging device is used in an image forming apparatus including fixing means adopting heat roller fixing method of fusing a toner image transferred to a sheet so as to fix the same on the sheet while transporting the sheet by heating and pressing rollers rotated at a specified speed. This sheet discharging device is provided with a sheet discharger including first and second rollers and arranged downstream from the fixing device, a contact point of the first and second rollers being located toward the pressing roller from a tangent line on a point of a circumferential surface of the heat heating roller which intersects with a straight line connecting centers of the heating and pressing rollers, and a drive mechanism for driving the first roller and the heating roller so that a speed of the first roller at the circumferential surface thereof is greater than that of the healing roller. Accordingly, a sheet curled in the fixing device can be straightened with a simple construction.

14 Claims, 6 Drawing Sheets

SHEET DISCHARGING DEVICE FOR USE IN AN IMAGE FORMING APPARATUS

BACKGROUND OF THE INVENTION AND RELATED ART STATEMENT

This invention relates to a sheet discharging device for use in a printer, copying machine, or like image forming apparatus.

Normally, a toner image formed by an imaging assembly including a photosensitive member or the like is transferred to a sheet by a transfer device in an image forming apparatus. The sheet bearing the toner image is discharged after having the toner image fixed thereto by a fixing device.

The fixing device normally adopts a heating roller fixing method so as to carry out a fixing operation safely at a high speed, and thus includes a heating roller and a pressing roller. The surface of the heating roller is formed of, for example, Teflon rubber, The pressing roller is pressed against the heating roller at a specified pressure. The sheet having the toner image transferred thereto is caused to pass between the heating roller and the pressing roller, and thereby the toner image is fixed onto the sheet due to the heat given from the heating roller and the pressure given from the pressing roller.

The sheet having the toner image fixed thereto is discharged by a discharging device arranged downstream from the fixing device. The discharging device includes a pair of a drive roller and a driven roller. The discharging device is arranged so that a contact point of the drive roller and the driven roller is positioned on such a transport line as to satisfy the following conditions. Specifically, the transport line is a tangent line on a point of a circumferential surface of the heating roller which intersects with a straight line connecting centers of the heating roller and pressing rollers (Japanese Unexamined Patent Publication No. 3-72389). FIG. 5 shows a construction of this conventional device. As shown in this figure, the drive roller 104 and the driven roller 105 of the discharging device 103 are arranged such that a contact point Z thereof is positioned on a tangent line Y at a point at the circumferential surface of the heating roller 101 which intersects with a straight line X connecting the centers of the heating roller 101 and the pressing roller 102 of the fixing device 100.

The reason why the discharging device 103 is arranged at the above position is considered as follows. The sheet passing through the fixing device 100 is transported uniformly by the heating roller 101 and the pressing roller 102 without bending toward either the heat roller 101 or pressing roller 102. In order for the discharging device 103 to nip a leading edge of the sheet transported from the fixing device 100, it is considered good to arranged the drive roller 104 and the driven roller 105 at the aforementioned position.

However, since the surface of the pressing roller 102 is softer than that of the heating roller 101 as described above, the sheet passing through the fixing device 100 is curled toward the heating roller 101 as shown in FIG. 6. Further in the fixing device 100, the toner depositing on the sheets by an electrostatic force or the like is heated and pressurized to be fused and deformed, thereby being fixed onto the sheet. Accordingly, the sheet tends to roll around the heating roller 101 due to the fused toner. Thus, the sheet is in reality transported while being curled toward the heating roller 101 as indicated by an arrow in FIG. 5. Therefore, even if the leading edge of the sheet is nipped and discharged properly by the discharging device 103, the curled state of the sheet inadvertently generated in the fixing device 100 is still found since no force is applied to straighten the curled sheet in the discharging device 103.

SUMMARY OF THE INVENTION

In view of the problems residing in the prior art, it is an object of the invention to provide a sheet discharging device for use in an image forming apparatus capable of discharging a sheet while straightening the sheet curled in a fixing device.

Accordingly, the invention is directed to a sheet discharging device for use in an image forming apparatus including fixing means adopting a heating roller fixing method of fusing a toner image transferred to a sheet so as to fix the same on the sheet while transporting the sheet by heating and pressing rollers rotated at a specified speed. This sheet discharging device comprises sheet discharge means including first and second rollers and arranged downstream from the fixing means, a contact point of the first and second rollers being located toward the pressing roller from a tangent line at a point of a circumferential surface of the heat heating roller which intersects with a straight line connecting centers of the heating and pressing rollers; and drive means for driving the first roller and the heating roller so that a speed of the first roller at the circumferential surface thereof is greater than that of the heating roller.

With the sheet discharging device thus constructed, when a leading edge of the sheet transported from the fixing means reaches the sheet discharge means, the sheet is discharged while being pulled more toward the pressing roller, thereby applying to the sheet such a force as to curl the sheet in a direction opposite to the curl generated in the fixing means. Further, a contact of the sheet with the circumferential surface of the heating roller at a discharge side can be reduced remarkably, with the result that the sheet is curled toward the heating roller to a lesser degree. Therefore, the curled sheet can be straightened.

The speed of the first roller at the circumferential surface thereof is preferably greater than that of the heating roller by 6% to 10%.

The contact point of the first and second rollers is advantageously located toward the pressing roller in such a manner that an angle defined between said tangent line and a line connecting a contact point of the heating and pressing and the contact point of the first and second rollers lies in a range of 2° to 11.3°.

These and other objects, features and advantages of the present invention will become more apparent upon a reading of the following detailed description and accompanying drawings.

DETAILED DESCRIPTION OF THE PREFERRED EMBODIMENT OF THE INVENTION

Figure 1:
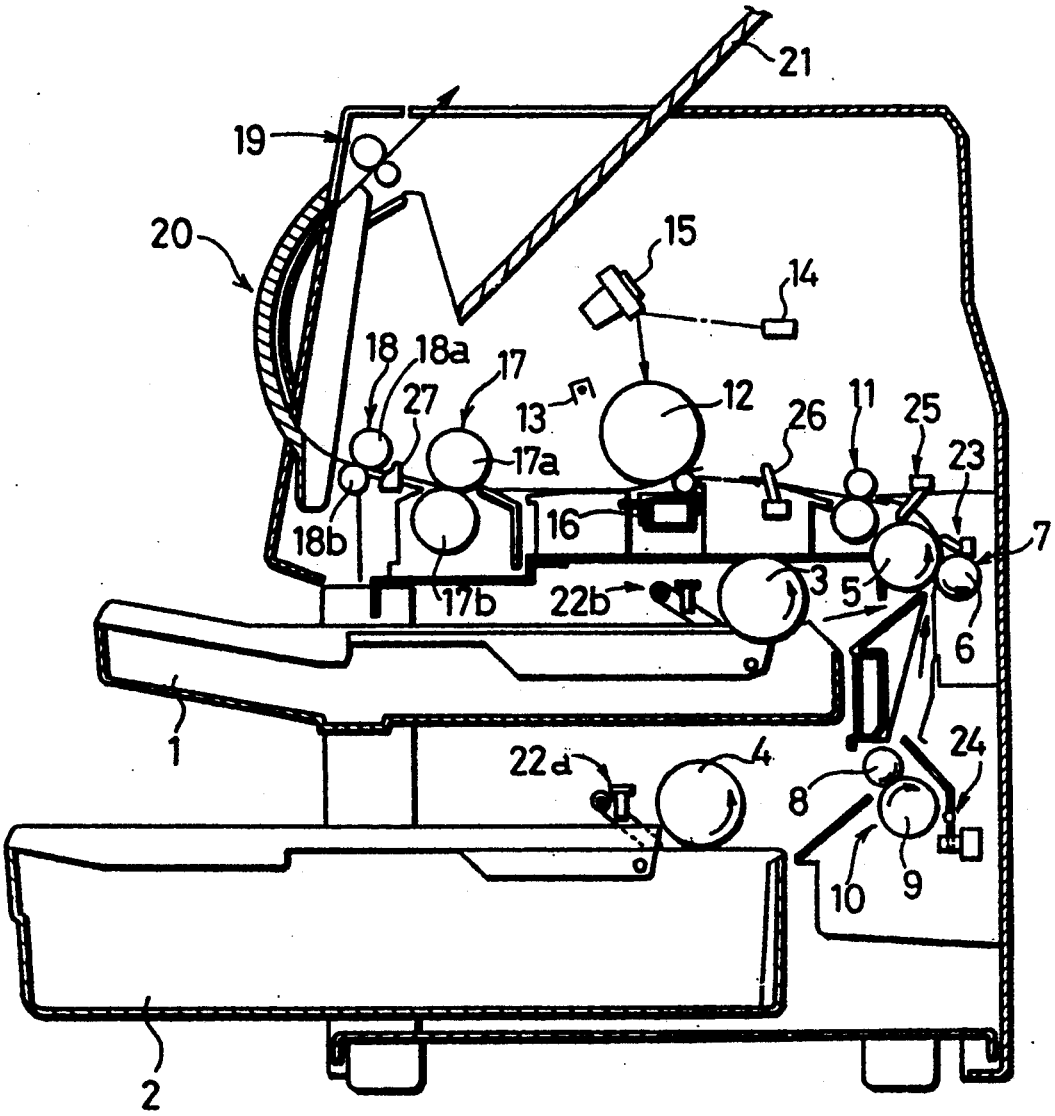
FIG. 1 is a sectional view showing a schematic construction of an image forming apparatus incorporating the invention.

An image forming apparatus incorporating the invention is described schematically with reference to FIG. 1.

The image forming apparatus is provided with a plurality of cassettes 1, 2, feed rollers 3, 4, a first pair of separating rollers 7, a second pair of separating rollers 10, a pair of registration rollers 11, a photosensitive member 12 in the form of a drum, a charger 13 and other unillustrated imaging devices arranged around the member 12, a light emitting device 14, a polygonal mirror 15, a transfer device 16, a fixing device 17, a discharging device 18, discharge guide 20, a discharge tray 21, a pair of discharge charge rollers 19, etc. The first separating roller pair 7 includes a forward roller 5 and a retard roller 6, and a second separating roller pair 10 includes a forward roller 8 and a retard roller 9. The light emitting device 14 includes a laser beam emitter for emitting a laser beam to print an image.

The image forming apparatus is further provided with sheet sensors 22*a*, 22*b*, first and second multifeed sensors 23, 24, a registration sensor 25, a timing sensor 26, a discharge sensor 27, and the like. The sheet sensors 22*a*, 22*b* detect the presence or absence of sheets in the cassettes 1, 2 respectively. The first and second multifeed sensors 23, 24 detect the multiple feeding of sheets. The registration sensor 25 is adapted for measuring a timing at which the registration rollers I1 are driven. The timing sensor 26 is adapted for measuring a timing at which the light emitting device 14 starts emitting the light. The discharge sensor 27 detects discharge of the sheet.

There will be next described an operation of thus constructed image forming apparatus. Sheets contained in the cassette 1 or 2 are dispensed by the feed roller 3 or 4, and are separated and transported one by one by the first and second separating rollers 7, 10. The separated sheet is nipped by the registration rollers 11.

Thereafter, when the registration rollers 11 start transporting the sheet and a sensor signal is output from the timing sensor 26, the photosensitive member 12 is driven in accordance with this sensor signal and image signals input from an unillustrated data storage of a storage medium externally connected to the image forming apparatus or arranged at a specified position thereof are optically modulated into modulated beams (laser beams) in the light emitting device 14, and emitted therefrom. The photosensitive member is exposed to this laser beam introduced by way of the polygonal mirror 15. The surface of the photosensitive member 12 is charged by the charger 13, and an electrostatic latent image is formed on a charged region of the member 12 by an exposing operation. Thus formed electrostatic latent image is developed into a toner image by an unillustrated developing device. This toner image is transferred to a sheet by the transfer device 16, and then fixed onto the sheet by the fixing device 17. The sheet bearing the image is transported to the discharging device 18, and is discharged onto the discharge tray 21 by the discharge rollers 19 through the discharge guide 20.

Figure 2:
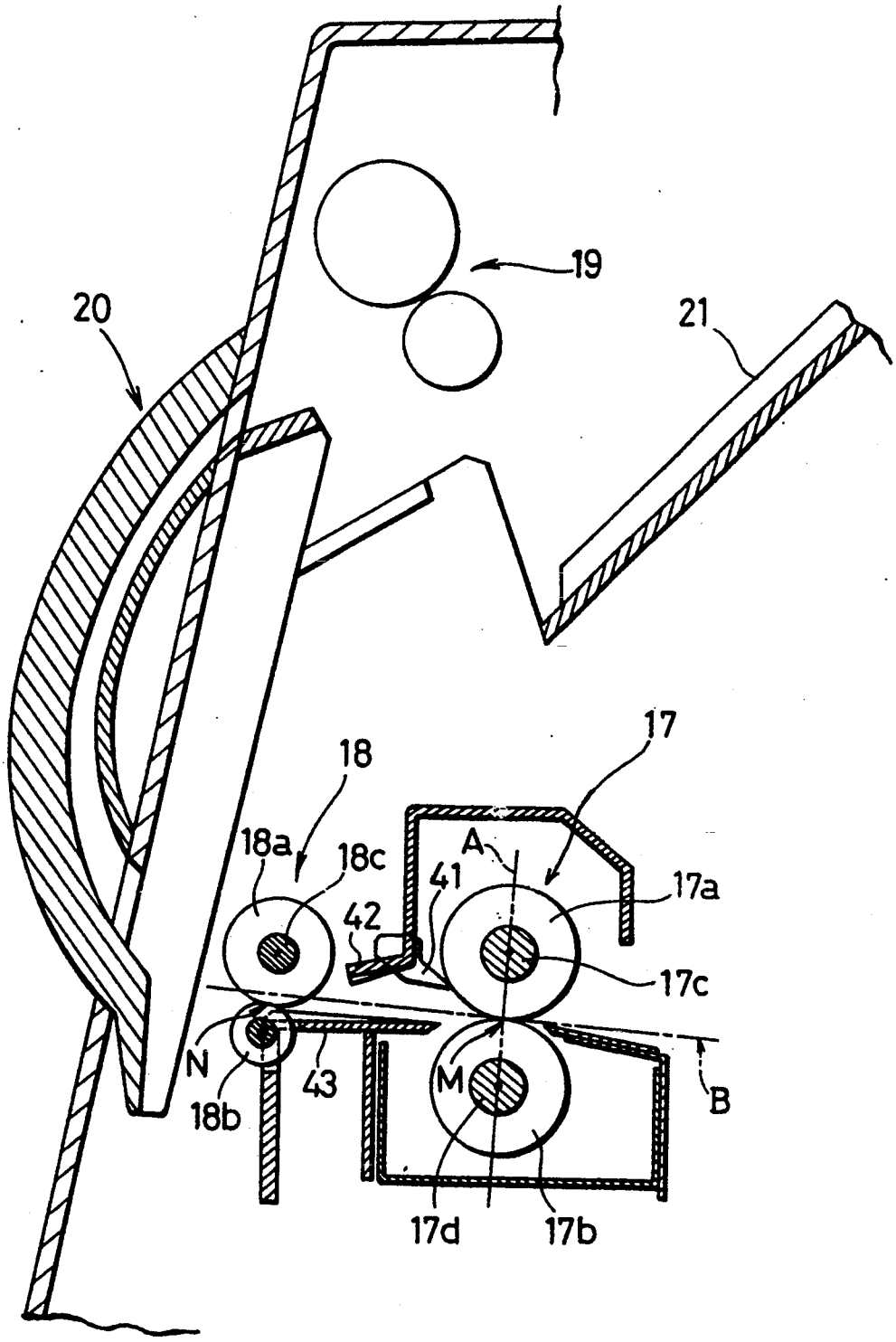
FIG. 2 is a sectional view showing a construction of a sheet discharging device embodying the invention.

There will be described the fixing device 17 and the discharging device 18 next with reference to FIGS. 2 and 3.

The fixing device 17 is adapted for heating the toner transferred to the sheet in a pressurized state and fusing the same to be fixed onto the sheet, and for transporting the sheet toward the discharging device 18. The fixing device 17 includes a heating roller 17*a* and a pressing roller 17*b*. The heating roller 17*a* is rotated at a specified speed, and a circumferential surface thereof is formed of a highly rigid material such as metal and Teflon. The heating roller 17*a* is provided internally with unillustrated heater, thermistor, and the like, and the temperature thereof is maintained at a fixed level of, e.g. 190° C. The pressing roller 17*b* has a circumferential surface thereof formed of a soft material such as silicon rubber, and is pressed against the heating roller 17*a* at a specified pressure. The sheet having the toner image fixed thereon is introduced by a separating blade 41 and transport guides 42, 43 and transported to the discharging device 18.

The discharging device 18 discharges the sheet having passed through the fixing device 17 toward the discharge guide 20, and includes a drive roller 18*a* and a driven roller 18*b* which is driven according to the drive roller 18*a*. The speed of the drive roller 18*a* at the circumferential surface (hereinafter referred to as a circumferential speed) is set greater than that of the heating roller 17*a* by a drive mechanism 30 to be described later. For example, the circumferential speed of the drive roller 18*a* is set greater than that of the heating roller 17*a* by 8%.

It will be appreciated that a diameter of the heating roller 17*a* is same as that of the pressing roller 17*b*, and diameter of the drive roller 18*a* is smaller than that of the heating roller 17*a*.

Figure 3:
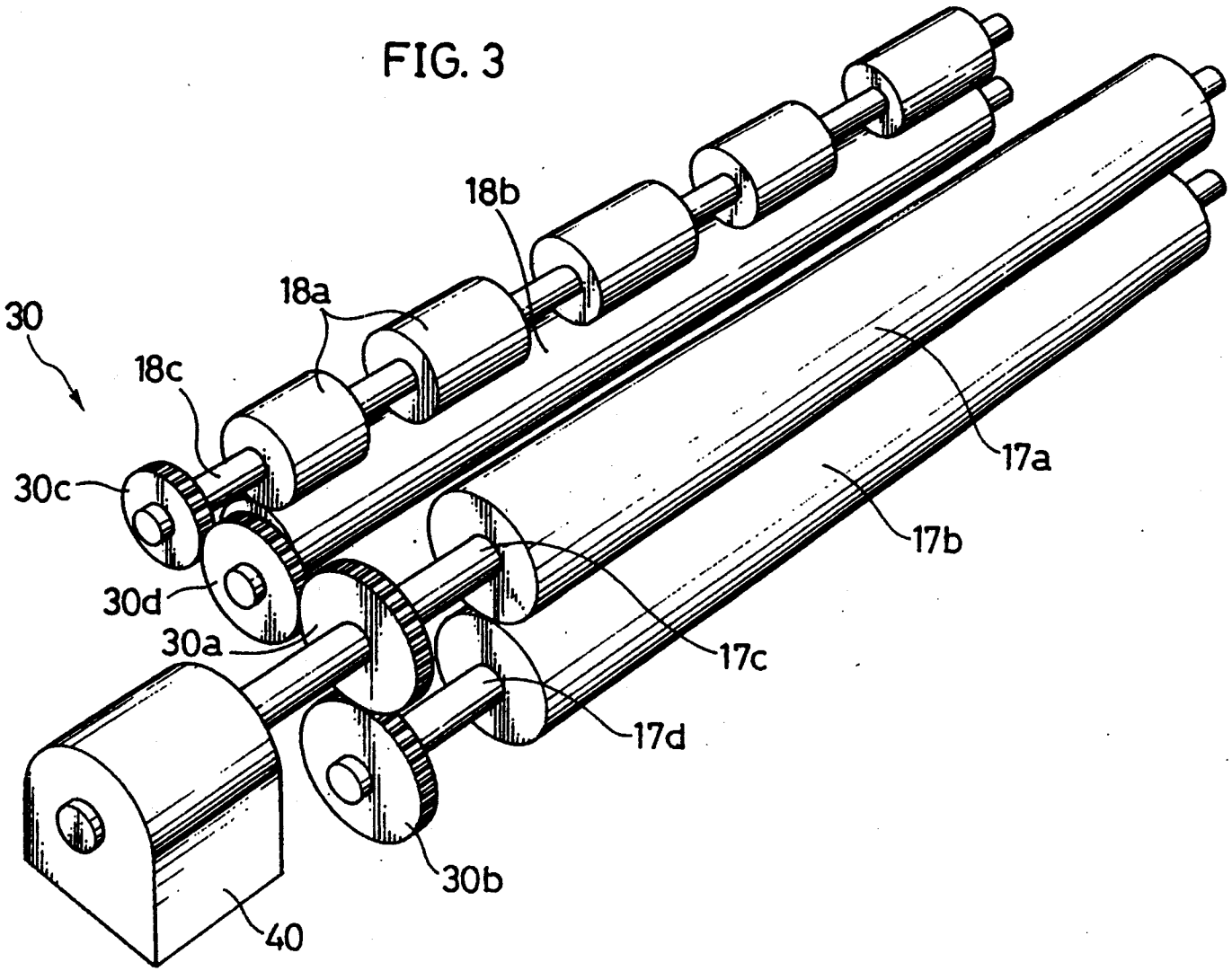
FIG. 3 is a perspective view showing a drive mechanism of the sheet discharging device.

The fixing device 17 and the discharging device 18 are driven by the drive mechanism 30 as shown in FIG. 3. The drive mechanism 30 includes a gear 30*a* fixed to a shaft 17*c* of the heating roller 17*a*, a gear 30*b* fixed to a shaft 17*d* of the pressing roller 17*b*, a gear 30*c* fixed to a shaft 18*c* of the drive roller 18*a*, and an intermediate gear 30*d* arranged between the gears 30*a* and 30*c*. The shaft 17*c* is coupled with a drive motor 40. The gear 30*b* is in mesh with the gear 30*a*, and the gear 30*c* moves in association with the gear 30*a* through the intermediate gear 30*d*.

The numbers of teeth of the gears 30*a* and 30*b* are set so that the heating roller 17*a* and the pressing roller 17*b* are rotatable at the same speed. The numbers of teeth of the gears 30*a*, 30*c*, 30*d* are set so that the circumferential speed of the drive roller 18*a* is greater than that of the heating roller 17*a* by predetermined amount.

Since the circumferential speed of the drive roller 18*a* is greater than that of the heating roller 17*a*, i.e. a speed at which the sheet is transported from the fixing device 17, the sheet is pulled by the discharging device 18. Accordingly, the sheet curled in the fixing device 17 can be straightened by an action to be described later. However, if the sheet is transported at the circumferential speed of the drive roller 18*a*, the sheet may be torn due to a difference in the circumferential speed between the heating roller 17*a* and the drive roller 18*a*. In order to avoid this, a pressure at which the drive roller 18*a* is in contact with the driven roller 18*b* is adjusted such that the sheet slips relative to the drive roller 18*a* in a desired manner. Thus, upon nipping the sheet transported from the fixing device 17, the discharging device 18 discharges the sheet by pulling and causing the same to slip.

There will be next described arrangement of the discharging device 18 relative to the fixing device 17. In FIG. 2, indicated at A is a straight line passing through centers of the heating roller 17*a* and the pressing roller 17*b*, at M an intersection of the line A and the circumferential surface of the heating roller 17*a*, at B a tangent line tangent to the circumferential surface of the heating roller 17*a* at the point M, and at N a contact point of the drive roller 18*a* and the driven roller 18*b*. In this example, the point N is located below the straight line B, i.e. more toward the pressing roller 17*b*. For example, an angle of 4.5° may be defined between the straight line B and a line connecting the points M and N.

Figure 4:
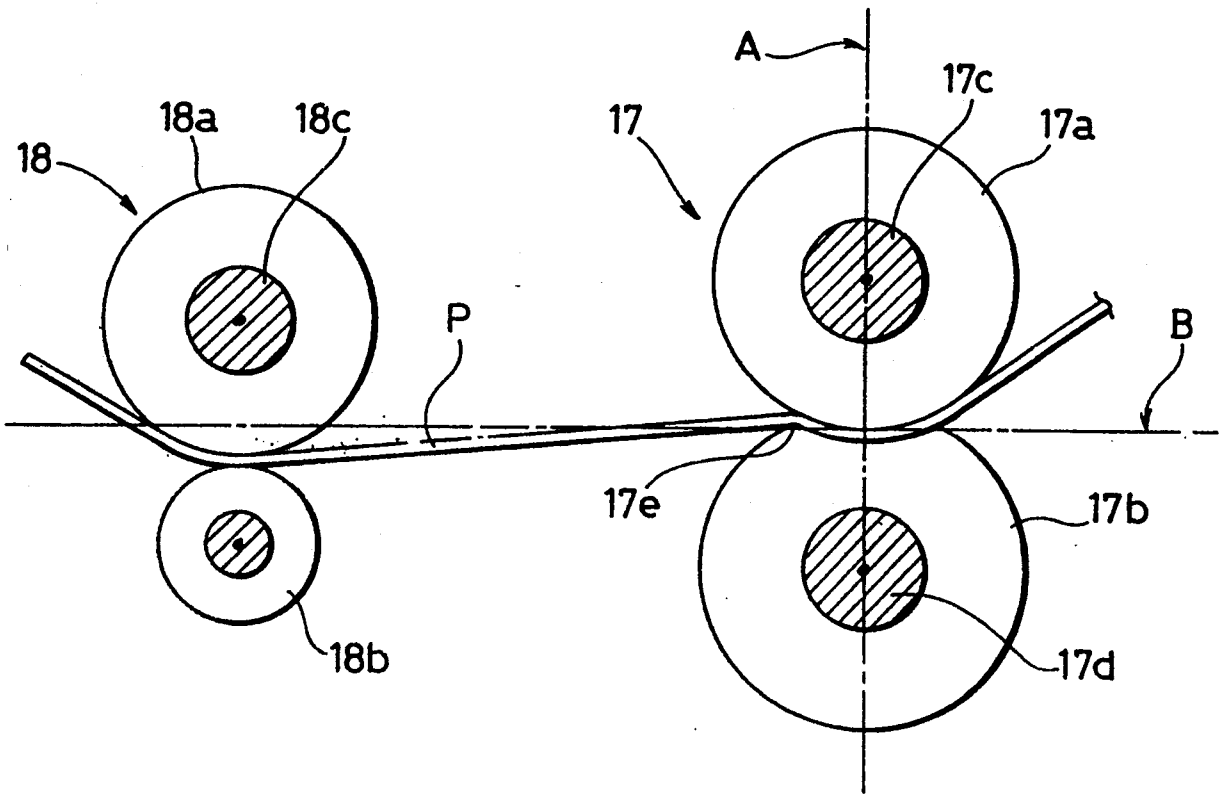
FIG. 4 is a schematic view showing a transported state of a sheet when the sheet discharging device is used.
Figure 5:
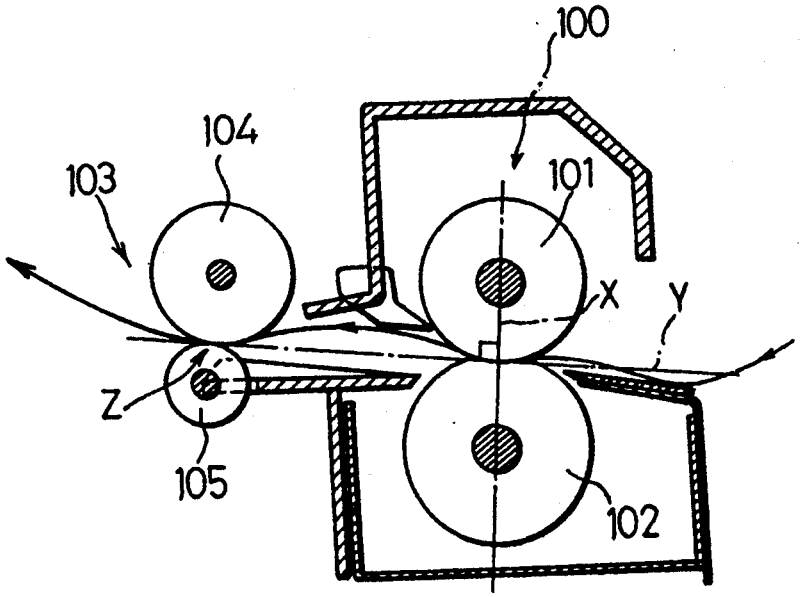
PRIOR ART FIG. 5
FIG. 5 is a schematic view showing a construction of a conventional sheet discharging device.
Figure 6:
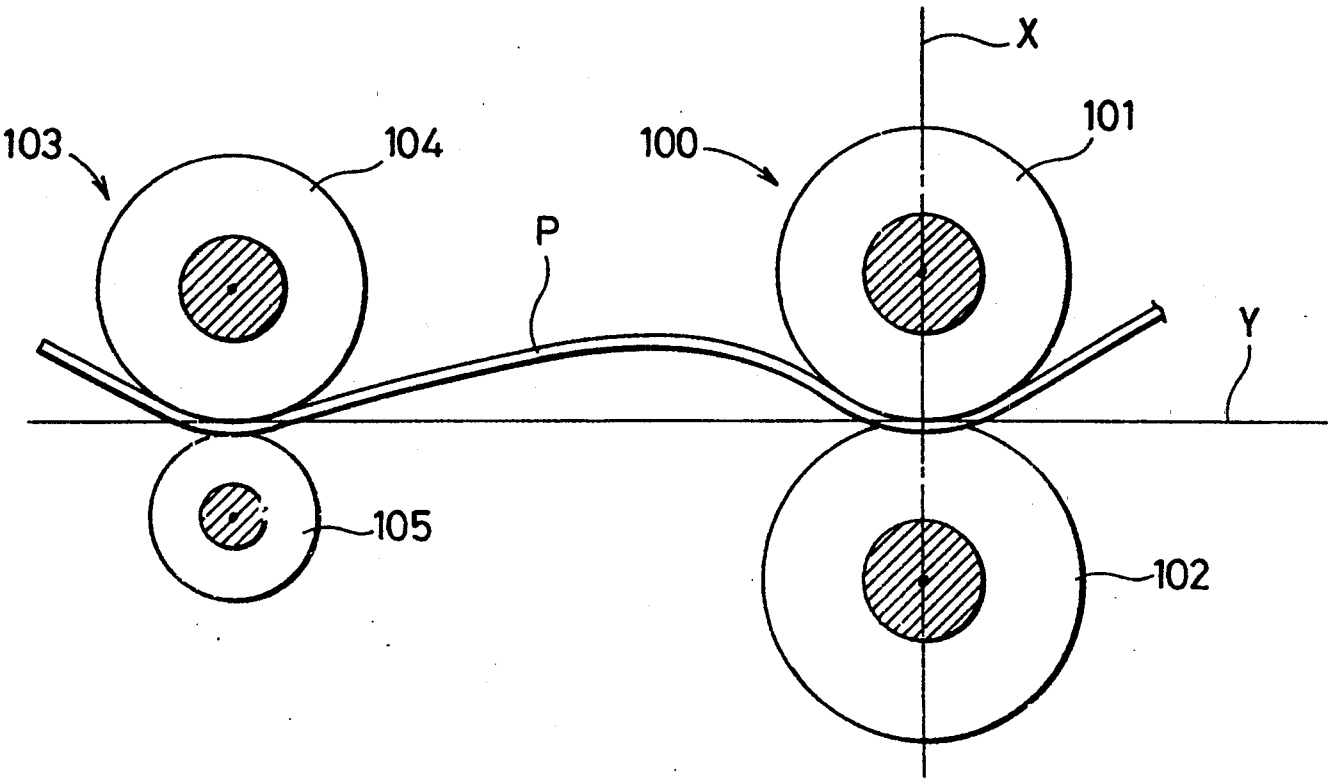
PRIOR ART FIG. 6
FIG. 6 is a schematic diagram showing a transported state of a sheet when the conventional sheet discharging device is used.

Accordingly, as shown in FIG. 4, the sheet P from the fixing device 17 is transported slightly downward from an end point 17*e* of the pressing roller 17*b*, thereby applying to the sheet such a force as to curl the sheet in a direction opposite to the curl generated in the fixing device 17. As a result, the sheet curled in the fixing device 17 can be straightened.

Further, since the circumferential speed of the drive roller 18*a* is set greater than that of the heating roller 17*a*, the sheet is transported while being pulled by the discharging device 18, thereby preventing the sheet from rolling around the heating roller 17*a*. Moreover, since the contact point of the drive roller 18*a* and the driven roller 18*b* is located toward the pressing roller 17*b* from the straight line B, the sheet is transported in a direction away form the heating roller 17*a*. Thus, the contact of the sheet with the heating roller 17*a* after the fixing operation can be reduced remarkably, with the result that the sheet is further unlikely to be curled.

The direction in which the sheet is in fact pulled by the discharging device 18 differs from the direction in which the sheet is transport from the fixing direction due to the angle defined between the line B and the line connecting the points M and N. Accordingly, it is required to set a greater circumferential speed difference when the above angle is made greater. In consideration of the relationship between the above angle and the circumferential speed difference, a pulling force to discharge the sheet properly when the angle is 4.5° can be obtained when the circumferential speed difference is set at 8%.

According to experiments conducted by the inventors, the above angle is preferably set in a range of 2° to 11.3°. This range is set for the following reasons. If the angle is smaller than 2°, the generated curl cannot be corrected satisfactorily. On the other hand, if the angle is greater than 11.3°, it becomes difficult for the discharging device 18 to nip the leading edge of the sheet. Further, the circumferential speed difference is preferably set in a range of 6% to 10%. This range is set for the following reasons. If the circumferential speed difference is smaller than 6%, the generated curl cannot be corrected satisfactorily. On the other hand, if the circumferential speed difference is greater than 10%, marks of rollers due to the slip in the discharging device 18 are found in the discharged sheet.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sheet discharge device for use in an image forming apparatus comprising:

fixing roller means for fixing a toner on a sheet by heating and pressing a sheet;

said fixing roller means comprising a heating roller and a pressing roller with each roller having an axis of rotation, said heating roller having an outer circumference whereby a point of intersection is defined where a reference line passing through the axes of rotation of said heating and pressing roller intersects said outer circumference of said heating roller;

discharge roller means disposed downstream of said fixing roller means such that the sheet passes from said fixing roller means to said discharge roller means;

said discharge roller means comprising first and second discharge rollers each having an axis of rotation and each being disposed to have peripheral contact with one another at a contact point;

said first and second discharge rollers being disposed relative to said fixing roller means such that an imaginary line perpendicular to said reference line and passing through said point of intersection intersects a line passing through the axes of rotation of said first and second discharge rollers at an intersecting point disposed between said contact point and the axis of rotation of said first discharge roller, the axis of rotation of said first discharge roller and the axis of rotation of said heating roller being on the same side of said imaginary line.

2. A sheet discharge device according to claim 1 wherein said imaginary line is designated a first imaginary line and wherein a second imaginary line which passes through said point of intersection and said contact point forms an acute angle with said first imaginary line with the apex of said acute angle being at said point of intersection.

3. A sheet discharge device according to claim 2 wherein the axis of rotation of said heating roller is located on the same side of said second imaginary line as said intersecting point.

4. A sheet discharge device according to claim 2 wherein said acute angle is from 2° to 11.3°.

5. A sheet discharge device according to claim 1 further comprising drive means for driving said fixing roller means and for driving said discharge roller means such that the circumferential speed of the whole circumferential surface of the first and second discharge rollers is greater than the circumferential speed of the whole circumferential surface of said heating roller.

6. A sheet discharge device according to claim 5 wherein the circumferential speed of the first and second discharge rollers is from 6% to 10% greater than the circumferential speed of said heating roller.

7. A sheet discharge device according to claim 5 wherein said drive means comprises a power means and intermeshing gears between said power means, said fixing roller means and said first and second discharge rollers.

8. A sheet discharge device according to claim 5 wherein at least one of said first and second discharge rollers has longitudinal ends and has an elongated circumferential surface which extends between said longitudinal ends, said heating roller having longitudinal ends and an elongated circumferential surface extending between the last said longitudinal ends, the circumferential speed of said elongated circumferential surface of said at least one discharge roller having greater than the circumferential speed of said elongated circumferential surface of said heating roller.

9. A sheet discharge device according to claim 8 wherein said elongated circumferential surface of said heating roller is a cylindrical surface having a substantially uniform diameter along its longitudinal length.

10. A sheet discharge device according to claim 8 wherein said elongated circumferential surface of said at least one discharge roller is a cylindrical surface having a substantially uniform diameter along its longitudinal length.

11. A sheet discharging device for use in an image forming apparatus including fixing means adopting a heat roller fixing method of fusing a toner image transferred to a sheet so as to fix the toner image on the sheet while transporting the sheet by a heating roller and a pressing roller rotated at a specified speed, comprising:

sheet discharge means including a first roller and a second roller arranged downstream from the fixing means, a contact point of the first roller and second roller being located such that an imaginary line perpendicular to a first reference line which connects the center of the heating roller and pressing roller at a point where the first reference line passes through the outer circumference of said heating roller intersects a second reference line passing through the axes of rotation of said first and second rollers at an intersection, said intersection being disposed between said contact point and the center of said first roller, the center of said first roller and the center of said heating roller being disposed on the same side of said imaginary line; and driving means for driving the first roller and the heating roller so that the speed of the whole circumferential surface of the first roller is greater than the speed of the whole circumferential surface of the heating roller.

12. A sheet discharge device for use in an image forming apparatus comprising:

fixing roller means for fixing a toner on a sheet by heating and pressing a sheet;

said fixing roller means comprising a heating roller and a pressing roller with each roller having an axis of rotation, said heating roller having an outer circumference whereby a point of intersection is defined where a reference line passing through the axes of rotation of said heating and pressing roller intersects said outer circumference of said heating roller;

discharge roller means disposed downstream of said fixing roller means such that the sheet passes from said fixing roller means to said discharge roller means;

said discharge roller means comprising first and second discharge rollers each having an axis of rotation and each being disposed to have peripheral contact with one another at a contact point;

said first and second discharge rollers being disposed relative to said fixing roller means such that a first imaginary line perpendicular to said reference line and passing through said point of intersection intersects a line passing through the axes of rotation of said first and second discharge rollers at a position overlying said contact point, a second imaginary line passing through said point of intersection and said contact point forming an acute angle with said first imaginary line with the apex of said acute angle being at said point of intersection, the position where said first imaginary line intersects the line passing through the axis of rotation of said first and second discharge rollers being designated a reference position, the axis of rotation of said heating roller being located on the same side of said second imaginary line as said reference position.

13. A sheet discharging device according to claim 12 wherein said fixing roller means comprises a single heating roller and a single pressing roller.

14. A sheet discharging device according to claim 6 wherein the circumferential speed of the first and second discharge rollers is about 8% greater than the circumferential speed of said heating roller, when said acute angle is about 4.5°.

* * * * *